US006638345B2

(12) United States Patent
Takahashi et al.

(10) Patent No.: US 6,638,345 B2
(45) Date of Patent: Oct. 28, 2003

(54) METHOD FOR COLLECTING REVERSELY SUBLIMING SUBSTANCE AND APPARATUS THEREFOR

(75) Inventors: Tsukasa Takahashi, Himeji (JP); Shigetaka Takamiya, Himeji (JP); Kenji Nakahara, Himeji (JP)

(73) Assignee: Nippon Shokubai Co., Ltd., Osaka (JP)

( * ) Notice: Subject to any disclaimer, the term of this patent is extended or adjusted under 35 U.S.C. 154(b) by 0 days.

(21) Appl. No.: 10/008,258

(22) Filed: Nov. 1, 2001

(65) Prior Publication Data

US 2002/0053288 A1 May 9, 2002

(30) Foreign Application Priority Data

Nov. 8, 2000 (JP) ..... 2000-340759

(51) Int. Cl.[7] ..... B01D 5/00; B01D 8/00
(52) U.S. Cl. ..... 95/288; 55/DIG. 15
(58) Field of Search ..... 95/288; 55/DIG. 15; 261/152, 153; 165/158

(56) References Cited

U.S. PATENT DOCUMENTS 2,189,173 A * 2/1940 Hebbard et al. ..... 585/834
2,602,647 A * 7/1952 Miller ..... 165/109.1
3,693,707 A 9/1972 Richter
4,252,545 A 2/1981 Haferkorn
4,842,055 A * 6/1989 Ohtsu ..... 165/174

FOREIGN PATENT DOCUMENTS

| | | |
|---|---|---|
| EP | 0 870 525 A1 | 10/1998 |
| JP | B-61-121 | 1/1986 |
| JP | A-4-131101 | 5/1992 |
| JP | A-10-265474 | 10/1998 |
| JP | A-10-279522 | 10/1998 |

* cited by examiner

*Primary Examiner*—Robert A. Hopkins
(74) *Attorney, Agent, or Firm*—Mathews, Collins, Shepherd & McKay

(57) ABSTRACT

A reversely subliming substance is efficiently collected on a commercial scale from a gas containing the substance. This is achieved by introducing the gas containing the substance into a shell-and-tube collecting apparatus by controlling the resistance offered to the gas during the passage thereof through the cooled tubes retained inside the collecting apparatus or by utilizing gas-introducing tubes excelling in dispersibility.

19 Claims, 1 Drawing Sheet

FIGURE
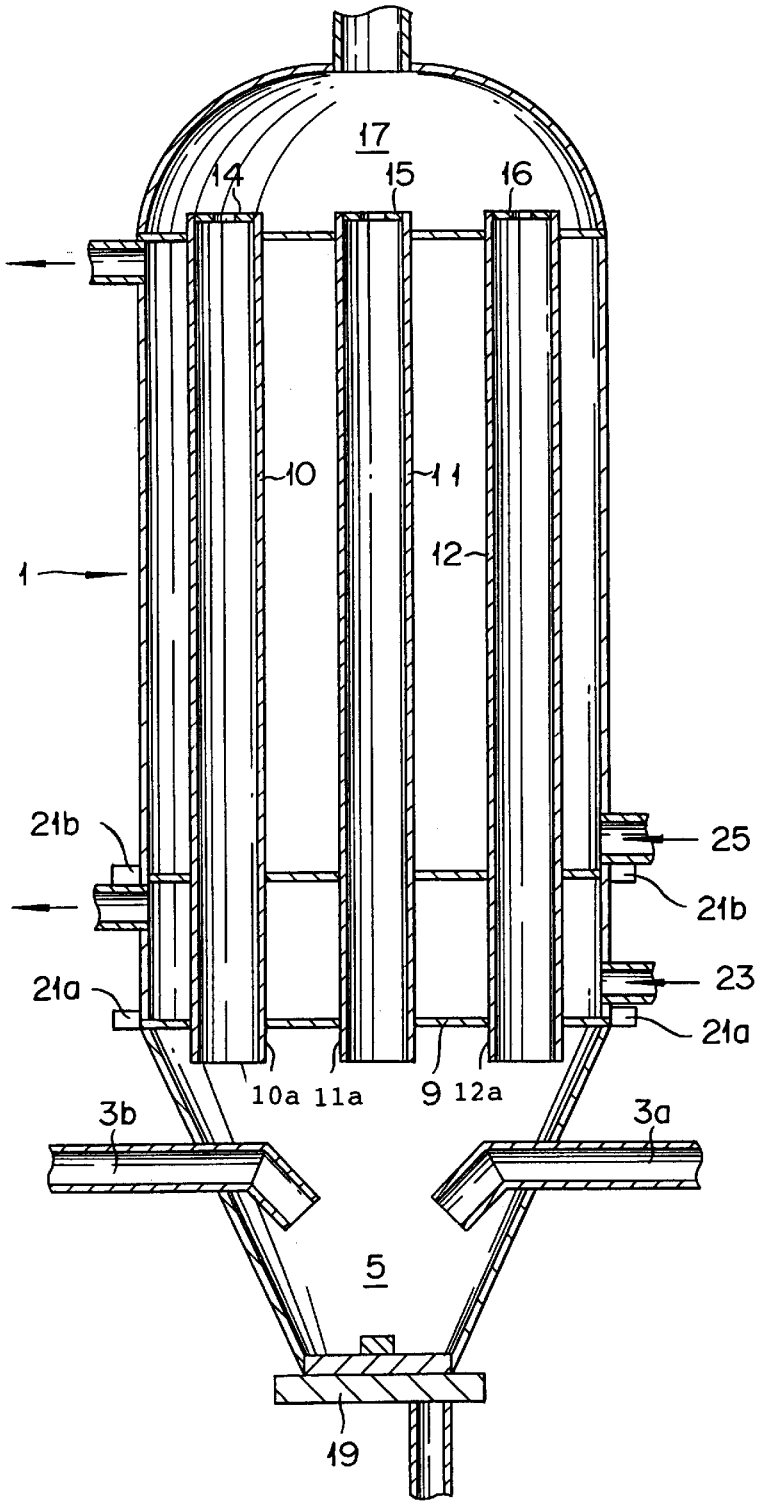

METHOD FOR COLLECTING REVERSELY SUBLIMING SUBSTANCE AND APPARATUS THEREFOR

BACKGROUND OF THE INVENTION

1. Field of the Invention

This invention relates to a method for collecting a reversely subliming substance from a gas containing the substance and an apparatus for the collection.

2. Description of Related Art

Various reports have been heretofore published concerning a method including synthesizing pyromellitic anhydride by the reaction of catalytic gas phase oxidation from durene, for example, as a raw material and collecting it from a gas containing the produced. Several methods utilizing a cooled wall surface have been available as shown below to obtain crystalline pyromellitic anhydride of a large size.

U.S. Pat. No. 4,252,545 discloses a method which includes causing a pyromellitic anhydride-containing gas to flow at a flow velocity in the range of 1–3 m/sec parallelly to a cooled surface maintained at an equilibrated temperature and recovering consequently formed crystals by the technique of fractional reverse sublimation. This method includes two versions, one causing the gas to flow down the interiors of a plural of tubes and the other causing the gas to flow to the heat-exchange surface of a plate curer. Basically, the method is intended to avoid deposition of crystals on the cooled wall surface to the fullest possible extent. The crystals thus deposited are so fast thereon to be periodically peeled by washing or mechanically. The method renders the operation of the relevant apparatus difficult.

U.S. Pat. No. 3,693,707 discloses an apparatus for precipitating crystals by reverse sublimation from a pyromellitic anhydride-containing gas by the use of fin tubes. This apparatus inevitably proves to be a very commercially expensive because the crystals once adhered to complicated surfaces such as the fin tubes are not easily peeled and recovered.

JP-B-61–121 discloses a method which includes exposing a pyromellitic anhydride-containing gas to reverse sublimation thereby inducing deposition and growth of crystals of the acid on a cooled wall surface, then elevating the temperature of the wall surface to a level exceeding the subliming temperature thereby effecting removal of adhered crystals by sublimation, and causing the residual grown crystals to separate from the wall surface and fall down, and an apparatus therefor. This method, however, entails the problem that the apparatus is complicated and that the loss in collection is aggravated because of the sublimation removal of the crystals.

JP-A-4-131,101 discloses a method which includes causing an air current containing a sublime compound to entrain wear-resisting particles thereby inducing precipitation of crystals to the cooled surface of a condenser and, at the same time, allowing the wear-resistant particles to collide against the crystals and peel them in a powdery form. This method, however, entails the problem that the product is only a powdery form and that the apparatus is subjected to wear by the collision of the particles.

JP-A-10-265,474 discloses a method which includes inducing precipitation of crystals on the cooled surface of a vertical tubular condenser and then elevating the temperature of the surface thereby causing the crystals to peel by subliming pressure. JP-A-10-279,522 discloses a method which includes inducing precipitation of crystals on a cooled surface and then lowering the temperature of the surface thereby causing the crystals to peel by virtue of the difference in shrinkage between the surface and the crystals. In the specification of this invention, no actual mode of embodiment is mentioned anywhere about a shell-and-tube type collector that is effective in commercially operating the method.

Thus, none of the methods is known sufficiently for commercial production of a reversely subliming substance of high purity and large size such as pyromellitic anhydride directly from a gas phase.

SUMMARY OF THE INVENTION

An object of the present invention is to provide a method for the recovery by fractional reverse sublimation a reversely subliming substance such as pyromellitic anhydride from a gas containing the substance in which highly pure, highly collected crystals are expelled out of the collection system, and an apparatus therefor.

The object of this invention is accomplished by a method for collecting a reversely subliming substance from a gas containing the substance by the use of a shell-and-tube type collector capable of effecting adhesion and collection of the substance on the inside surfaces of cooled collection tubes in which the pressure loss at which the gas passing through the cooled tubes is adjusted in the range of 0.05 to 50,000 Pa.

The object of this invention is also accomplished by a method for collecting a reversely subliming substance from a gas containing the substance by the use of a shell-and-tube type collector capable of effecting adhesion and collection of the substance on the inside surfaces of cooled collection tubes in which the cooled tubes have a common, empty space formed in the lower part of the collector for gas-introducing tubes and the gas is introduced within the empty space by adopting at least one of the following means:

(1) a gas-introducing tube with a perforated plate at the outlet part thereof, (2) a gas-introducing tube the outlet direction of which has an angle larger than 90° relative to the directions in which the gas passes through the cooled tubes, and (3) two or more gas-introducing tubes.

The object of the invention is further accomplished by a shell-and-tube type apparatus for adhering and collecting a reversely subliming substance from a gas containing the substance in which the outlet parts of cooled tubes formed in the shell-and-tube type apparatus are each provided with baffle plates.

According to the method of the invention, it is possible to level the amount of the gas containing the reversely subliming substance which passes through the individual cooled tubes and increase the collection coefficient of the substance by adjusting the resistance at a prescribed pressure loss at which the gas passes through the cooled tubes retained in the shell-and-tube type collector.

According to the method of the invention, the amount of the gas containing the reversely subliming substance which passes through the individual cooled tubes retained in the shell-and-tube type collector can be leveled and the collection coefficient of the substance can be increased since the gas can be efficiently dispersed during the collection thereof by the use of a shell-and-tube type collector.

According to the collector of the invention, it is possible to level the amount of the gas containing the reversely subliming substance which passes through the individual cooled tubes and increase the collection coefficient of the substance by introducing the gas into the collector with a gas-introducing tube which excels in the ability to disperse the gas and disposing a baffle plate to each at the outlet parts of the cooled tubes retained in the collector thereby controlling the resistance of the cooled tubes.

The above and other objects, features and advantages of the present invention will become clear from the following description of the preferred embodiments.

BRIEF DESCRIPTION OF DRAWING

The accompanying drawing incorporated in and forming a part of the specification, illustrates several aspects of the present invention, and together with the description serve to explain the principles of the invention. In the drawing:

The drawing is a cross section illustrating one example of the apparatus for collecting the reversely subliming substance according to this invention.

DETAILED DESCRIPTION OF THE PREFERRED EMBODIMENTS

The method for collecting a reversely subliming substances or desubliming substance and the apparatus for effecting the collection according to this invention will be described below with reference to the drawing accompanying hereto. FIGURE is a sectioned explanatory diagram illustrating the apparatus of the invention for collecting the reversely subliming substance. The tubes appearing in the FIGURE are exaggerated for the sake of clarifying the description. The term "reversely subliming substance" as used herein refers to a sublime substance that is transformed from vapor to solid state. Examples of the sublime substances may include pyromellitic anhydride, phthalic anhydride, maleic anhydride, anthraquinone, naphthalic anhydride, benzoic acid, phenyl maleic anhydride, phenanthrene, and nicotinic acid. Among the sublime substances mentioned above, pyromellitic anhydride proves particularly favorable. This invention will be described below with pyromellitic anhydride cited as typical example.

The pyromellitic anhydride-containing gas is not particularly restricted but only required to contain the pyromellitic anhydride. Generally, the gas is preferred to contain the pyromellitic anhydride (it may be referred to as "PMDA".) that is obtained by the reaction of catalytic gas phase oxidation from durene as a raw material. Various known catalysts can be used for the reaction. A catalyst containing vanadium and silver as essential components and having the atomic ratio of silver to vanadium in the range of 0.0001 to 0.2:1 may be cited as one example.

The reversely subliming substance-containing gas mentioned above generally contain the reversely subliming substance at a concentration in the range of 5 to 50 g/Nm$^3$, preferably in the range of 15 to 35 g/Nm$^3$.

The gas containing PMDA is introduced via a gas-introducing tube 3 into an empty space 5 in the lower part of a vertical, shell-and-tube type collecting apparatus or collector 1. The term "vertical shell-and-tube type collector" as used herein refers to an apparatus having two or more tubes or collection tubes of a fixed diameter disposed in a cooled column and keeping the wall surfaces of the tubes cooled with a refrigerant thereby cooling a substance passing through the interiors of the cooled collection tubes by virtue of the heat exchange between the substance and the inside wall surfaces of the cooled tubes. The word "vertical" means such an apparatus that the longitudinal directions of the cooled tubes are parallel to the gravity direction in which the peeled crystals can be expelled out of the cooled tubes by means of gravity. The empty space 5 for gas-introducing tubes 3 is located in the lower part of the collector 1 and encompassed by the bottoms of the plurality of cooled tubes 10, 11, and 12, the lower lateral wall of the collector 1, and a crystal-discharging device 19. In this construction, it is preferable to provide perforated plates for the gas-introducing tubes at the outlet parts thereof, dispose the gas-introducing tubes in such a manner that the discharging directions are enabled to form dispersion angles larger than 90° relative to the direction of the gas which passes through the cooled tubes, and set plural of gas-introducing tubes. The adoption of such methods ensures that the PMDA-containing gas does not directly enter into the cooled tubes, and that the PMDA-containing gas can be dispersed and uniformly distributed through the cooled tubes.

The perforated plate is generally so fixed that the pressure loss falls below 10,000 Pa, preferably in the range of 100 to 5,000 Pa, though the number of the perforation depends on the amount of the flowed gas and the size of the collector. The holes formed in the perforated plates are not restricted on their shape, which may be arbitrarily selected from among circle, triangle, quadrilateral, and rectangle.

The gas-introducing tubes are so disposed that the directions of gas discharge thereof form an angle greater than 90°, preferably in the range of 90 to 270°, more preferably in the range of 120 to 240°, relative to the directions of the gas that passes through cooled tubes 10, 11, and 12. The use of such gas-introducing tubes provides excellent dispersion of the gas containing a reversely subliming substance. Alteration of the discharge directions may be effected by two means: one setting the gas-introducing tubes directly at a prescribed angle or another connecting other tubes to the outlets of the gas-introducing tubes. Where the collector has a small diameter, the latter is more effective because the empty space available is small.

Further, the collector is provided favorably with a plurality, i.e. in the range of 2 to 10, of gas-introducing tubes 3*a,* and 3*b* from the viewpoint of improving the dispersibility of the introduced gas. Where a plurality of gas-introducing tubes 3*a,* and 3*b* are installed, it is allowable to dispose them at arbitrary positions and to form arbitrary dispersion angles and further to produce severally different gas flow volumes per each of them. It is advantageous to have the gas-introducing tubes 3*a,* and 3*b* disposed uniformly on one plane at equal dispersion angles from the viewpoint of controlling the dispersibility. Where two gas-introducing tubes 3*a,* and 3*b* are adopted, it is advantageous to have them opposed to each other substantially in one plane at equal dispersion angles.

Then, the PMDA-containing gas is introduced through the gas-introducing tubes 3*a, b* into the collector 1 provided with a plurality of cooled tubes 10, 11, and 12, and the dispersed gas enters the cooled tubes 10, 11, and 12, in which the PMDA is separated from the gas and deposited on the inside surfaces of the cooled tubes 10, 11, and 12. Properly, the cooled tube has a larger diameter (inside diameter), generally in the range of 100 to 500 mm, preferably in the range of 150 to 400 mm, and more preferably in the range of 150 to 300 mm. If the inside diameter of the cooled tubes falls short of 100 mm, the shortage will be at a disadvantage in rendering it difficult to separate and recover the collected crystals. Conversely, if the inside diameter exceeds 500 mm, the excess will be at a disadvantage in lowering the collection coefficient of the PMDA. The length of tubes used in the present invention is not particularly limited but may be in the range of 3,000 to 6,000 mm. If the length is too short, it will not achieve sufficient recovery of the objective substance. Conversely, if the length is too long, it will increase costs for equipments though yields thereof is of short. The tubes of the conventional shell-and-tube type heat exchanger, however, have relatively small tube diameters, e.g. 25.4 mm, for the purpose of exalting the heat-exchange capacity of the exchanger per unit volume.

The tubes 10, 11, and 12 are cooled with a refrigerant. It is advantageous to effect this cooling by the use of a plurality of refrigerants from the viewpoint of facilitating deposition of the PMDA and separation of the deposited PMDA. FIGURE depicts one example of effecting the cooling by two kinds of refrigerants. When two kinds of refrigerants are used, the temperature of the introduced gas generally falls in the range of 150° C. to 300° C. at the inlets of the cooled tubes, then the refrigerants have lower temperatures than that of the introduced gas and it is advantageous to use a refrigerant 23 of a higher temperature on the inlet sides of the cooled tubes 10, 11, and 12 and a refrigerant 25 of a lower temperature on the outlet sides thereof from the viewpoint of promoting deposition of the PMDA and separation of the deposited PMDA. The higher refrigerant temperature is generally in the range of 140° C. to 250° C., preferably in the range of 180° C. to 240° C. Specifically, about 200° C. may be cited as an example. Meanwhile, the lower refrigerant temperature is generally in the range of 140° C. to 190° C., preferably in the range of 160° C. to 190° C. Specifically, about 170° C. may be cited as an example. It is further advantageous to set a temperature difference of not more than 60° C. between the higher refrigerant and the lower refrigerant. Setting this difference is effective in preventing the occurrence of pulverization of crystals by rapidly cooling. The range of length to be cooled with the high temperature refrigerant is generally not more than 50%, preferably not more than 20% of the length of the cooled tube. The refrigerants may flow in parallel or counter to the direction in which the gas flows through the cooled tube.

Further, where the temperature distribution of the refrigerant is to be allayed, it is favorable to have a baffle (a notch of 25%, for example) or a disc-doughnut type baffle plate disposed in the flow path for the refrigerant. When doughnut, disc, and doughnut type baffle plates are disposed sequentially from the lower side upward (not shown), the refrigerant ascends through the hole of the doughnut, then moves horizontally between the doughnut and the disc type baffle plates, ascends on the lateral wall of the collector between the peripheral part of the disc type baffle plate and the collector, then moves horizontally between the disc and the doughnut type baffle plates, again ascends through the hole of the doughnut, and keeps moving similarly thereafter. Owing to the fact that the refrigerant positively moves in the lateral direction in the collector as described above, it can repress the temperature distribution particularly in the lateral direction. It is possible to cool the tubes more uniformly and decrease quality dispersion of the crystals to be deposited on the inside surfaces of the cooled tubes by repressing the temperature distribution as described above.

Where the baffle plates are used in the collector, since the refrigerant moves in the horizontal direction, it is advantageous to have plural of outlets and inlets for the refrigerants disposed in the peripheral part of the collector for the purpose of further allaying the temperature distribution of the refrigerant. By this introduction, it is possible to more allay the temperature distribution of the refrigerant as compared with the one place introduction because the refrigerant is introduced substantially through the entire periphery of the collector. Likewise when the refrigerant is discharged from the collector, the temperature distribution of the refrigerant can be allayed in the same manner as mentioned above. The quality dispersion of the crystals deposited on the inside surfaces of the cooled tubes can be allayed since the temperature distribution of the refrigerant within the collector is repressed as described above.

The gas inlet parts 10*a,* 11*a,* and 12*a* of the cooled tubes 10, 11, and 12 are preferred to project downward from the tube sheet 9. Properly, they are projected in a length generally in the range of 10 to 500 mm, preferably in the range of 50 to 300 mm, into the lower empty space 5 of the collector 1. By the projection of the cooled tubes, the collection efficiency and recovery percentage of the PMDA are both improved. This reason for improvement is not clarified but the improvement may be explained by a supposition that the projected parts 7 has a function as baffle plates thereby disturbing the flow of the introduced gas within the lower empty space 5 and uniformizing or unify the gas introduced into the individual cooled tubes 10, 11, and 12, and that the PMDA crystals are hard to be adhered to the projected parts 10*a,* 11*a,* and 12*a,* so that it carves the crystals deposited on the bottom of the tube sheet 9 from the crystals deposited inside the cooled tubes 10, 11, and 12, thereby promoting the fall of the crystals.

The cooled tubes 10, 11, and 12 are preferably provided at the gas outlet thereof each with baffle plates 14, 15, and 16 so as to adjust the resistance offered to the cooled tubes 10, 11, and 12. The baffle plate is not particularly limited on account of shape, but may include a plate having a hole at a prescribed diameter formed in the central part and a cone having the top parts thereof truncated, which is disposed in the upper ends of the cooled tubes, respectively. Properly, the pressure loss is generally in the range of 0.05 to 50,000 Pa, preferably in the range of 1 to 10,000 Pa. If the pressure loss falls short of 0.05 Pa, the shortage will be at a disadvantage in not sufficiently uniformizing the gas flow in the individual cooled tubes. Conversely, if this pressure loss exceeds 50,000 Pa, the excess will be at a disadvantage in requiring the ability of a blower to be unduly increased and consequently entailing an addition to the cost without producing any special merit.

It is possible to level the linear velocity of the gas flowing inside the individual cooled tube by causing the gas containing the reversely subliming substance to be dispersed in the lower empty space of the collector without directly turning the discharge direction of the gas-introducing tubes toward the cooled tubes and further controlling the resistance to the individual cooled tubes. The average velocity in the cooled tubes is generally in the range of 0.05 to 1 Nm/sec, preferably in the range of 0.05 to 0.5 Nm/sec. The observance of this range brings an effect of avoiding the possibility of deviating from 0.065 Nm/sec, i.e. the 50% value of the average linear velocity, 0.13 Nm/sec, inside the cooled tubes and 0.195 Nm/sec, i.e. the 150% value of the average linear velocity.

In the collector 1, the wall surface that is exposed to an upper empty space 17 is preferably maintained at a temperature higher than the temperature at which the PMDA crystals are precipitated. By adopting this higher temperature, it is possible to prevent the crystals from being precipitated, prevent the holes in the baffle plates 14, 15, and 16 from being blocked with the falling crystals, thereby continuing the operation for a long time.

Part of the PMDA crystals adhered to the cooled tubes 10, 11 and 12 are spontaneously separated and allowed to fall.

It is effective to provide the collector 1 on the outer periphery thereof at the points seating the cooled tubes with vibrating or striking devices 21*a,* and 21*b* for the purpose of promoting this separation. Though the striking devices may be operated intermittently or concentrically, it is advantageous to perform the operation concentrically after the crystals have accumulated to a certain extent in consideration of the spontaneous fall of the crystals and from the viewpoint of the energy efficiency. It is generally advantageous to have a plurality of such striking devices installed though the number of striking devices to be installed varies with the size of the collector and the striking efficiency. The striking device is not particularly restricted on account of location, but disposed on the tube sheet with a view to enhancing the separation effect of the crystals. Further, it is possible to promote the separation of the crystals deposited on the cooled tubes by starting the operation of the striking devices after the refrigerant temperature has been elevated to a level higher, such as 250° C., than the temperature during the course of cooling or it has been lowered to a level lower, such as 30° C., than the temperature during the course of cooling. Though the mechanism for this promotion of the separation is not elucidated fully, it may be explained by a supposition that the temperature difference between the surface layer of crystals deposited on the cooled tube and the thermal expansion of the tubes exerts a strain to the mass of crystals, inflicts a crack in the layer of precipitated crystals, thereby promoting the fall of the crystals.

The crystals that have separated and fallen are accumulated in the lower part or bottom of the collector. The crystals accumulated in this manner are of needles and, therefore, so deficient in fluidity as to render their expulsion difficult. We have further studied a method that is capable of expelling the separated crystals out of the collector. They have consequently found that it is possible to facilitate the expulsion of the crystals from the collector by forming the lower part of the collector in a conical shape having an angle of not less than 30°, for example, preferably 50 to 80°, based on the horizontal, thereby falling the crystals quickly and further by providing the collector 1 with a discharging device 19 such as, for example, a circle feeder, which is capable of exerting force directly on the accumulated crystals. When the discharging device 19 itself is devoid of a function to block from the ambience of the collector, it becomes necessary to provide the discharging device separately with a blocking device to prevent the gas from leaking out of the collector and prevent the air and extraneous matter from invading into the collector.

The cooled tubes and the conical lateral wall disposed in the lower part of the collector, which directly contact the PMDA crystals, are enabled by a grinding treatment so performed as to set the relative roughness, Ry {JIS (Japanese Industrial Standard) B0601 1994}, at 9.8 ($\mu$m), preferably 5 ($\mu$m), and more preferably 1 ($\mu$m) to fulfill the function of facilitating the separation and recovery of the crystals. The method of grinding is not particularly restricted on account of operation. The buffing technique and the electrolytic polishing technique may be cited as examples.

The gas that has passed through the cooled tubes contains the PMDA partly. It is gathered in the upper empty space 17 of the collector 1 and then treated as in an exhaust gas combustion device (not shown) so as to burn flammable substances such as PMDA. Optionally, this gas may be subjected to secondary collection to collect the PMDA prior to the combustion of the exhaust gas. The secondary collection can be effected by a collecting implement such as a cyclone, a bag filer, a washing column, or a wetting column.

According to the present invention, it can obtain crystals of relatively large size.

EXAMPLES

The present invention will be explained with reference to examples but not limited to these examples.

Example 1

A collector as illustrated in FIGURE was adapted to operate under the following conditions.

(Outline of collecting apparatus)

(i) Polishing (inside surfaces of cooled tubes): Electrolytic polishing

Inside diameter 200 mm and length 4,000 mm

These tubes were provided each in the top with a plate orifice having a thickness of 2 mm and containing holes 80 mm in diameter.

(ii) PMDA gas-introducing tubes: Two tubes were furnished with bends exhibiting angles of 180° relative to the direction in which the gas passes through the cooled tubes at the outlets of the gas-introducing tubes disposed in the lower empty space of the shell-and-tube collector.

(iii) The length of the cooled tubes projecting from the lower tube sheet: 100 mm.

(iv) Solvent 1: This cools 15% of the lengths of the cooled tubes from the gas inlets thereof.

(v) Solvent 2: This cools the remainders of the cooled tubes.

(vi) The angle of the conical part in the lower part of the collector: 500 based on the horizontal.

(vii) Ry of the conical part in the lower part of the collector: 1 ($\mu$m).

The collection was performed by the following method. The gas formed by the gas phase oxidation of durene and containing PMDA at a concentration of 33.2 g/Nm$^3$ was introduced via the PMDA gas-introducing tubes into the collector at a flow volume such that the linear velocity of gas within the collector was set at 0.3 Nm/sec. At this time, the pressure loss during which the gas passed through the cooled tubes was 0.1 Pa and the pressure loss between at the gas inlets and at the orifices disposed at the top of the cooled tubes was 2,000 Pa. The PMDA-containing gas was introduced into the collector for 24 hours, with the temperature of the refrigerant 1 kept at 195° C. and that of the refrigerant 2 at 170° C. Thereafter, the PMDA that had adhered to the cooled tubes was desorbed and fell off by actuation of the striking devices. The amount of the PMDA discharged from the discharging device disposed in the lower part of the collector was 72% by weight (recovery percentage) and the purity of the recovered crystals was 99.9%.

The operation of the collector was further continued for five days under the same conditions as in the operation mentioned above. At the end of the five days' operation, the introduction of the PMDA-containing gas into the collector was stopped and the temperatures of the refrigerants 1 and 2 were changed both to 30° C. When the striking device was actuated thereafter, the crystals adhered to the tubes were fell, the purity of which was 99.9%.

The average recovery percentage of the PMDA over a period of six days including the fallen crystals was 85.5% by weight. The PMDA crystals had the shape of a needle, the average size of which was 400 $\mu$m.

The air was fed at such a ratio as to set the average velocity thereof in the cooled tubes at 0.13 Nm/sec and the linear velocities at the outlet of the individual cooled tubes measured. None of the linear velocities in the individual tubes fell short of 0.065 Nm/sec, i.e. 50% of the average linear velocity or surpassed 0.195 Nm/sec, i.e. 150% of the average linear velocity. The highest value was 121% of the average linear velocity and the lowest value was 64.7% of the average linear velocity.

Comparative Example 1

(Omitting orifices)

The procedure of Example 1 was repeated except that all the orifices were omitted from the tops of the cooled tubes. The PMDA-containing gas was similarly introduced in the collector for 24 hours. The recovery percentage of the PMDA removed by the striking device was 66% by weight.

Operation of the collector was further continued for five days under the same conditions, then the introduction of the PMDA-containing gas into the collector was stopped, and the temperatures of the refrigerants 1 and 2 were both changed to 30° C. When the striking device was actuated, additional fall of crystals ensued. These crystals had purity of 99.9%.

The average recovery percentage of the PMDA over a period of six days including the fallen crystals was 75% by weight. The PMDA crystals had the shape of a needle.

After the orifices had been removed from the collector, the air was supplied thereto at such a ratio as to set the average velocity inside the cooled tubes at 0.13 Nm/sec and the linear velocities in the tops of the individual cooled tubes were measured. The linear velocities in the individual cooled tubes which fell short of 0.065 Nm/sec. i.e. 50% of the average linear velocity, accounted for 22% of all the velocities and those which exceeded 0.195 Nm/sec, i.e. 150% of the average linear velocity, accounted for 30% of all the velocities. The highest value was 243% of the average linear velocity and the lowest value was 24.3% of the average linear velocity.

Comparative Example 2

(Omitting both orifices and gas-introducing tubes)

The procedure of Example 1 was repeated except that all the orifices were omitted from the tops of the cooled tubes and the PMDA gas-introducing tubes omitted. The PMDA-containing gas was similarly introduced in the collector for 24 hours. The recovery percentage of the PMDA by the striking device was 55% by weight.

Operation of the collector was further continued for five days under the same conditions, the introduction of the PMDA-containing gas into the collector was stopped, and then the temperatures of the refrigerants 1 and 2 were both changed to 30° C. When the striking device was actuated, additional fall of the crystals ensued. The purity of the crystals was 99.9%.

The average recovery percentage of the PMDA over a period of six days including the fallen crystals was 65% by weight. The PMDA crystals had the shape of a needle.

After the orifices and the bent parts had been removed from the collector, air was supplied thereto at such a ratio as to set the average velocity inside the cooled tubes at 0.13 Nm/sec and the linear velocities in the outlet parts of the individual cooled tubes were measured. The linear velocities in the individual cooled tubes which fell short of 0.065 Nm/sec. i.e. 50% of the average linear velocity, accounted for 53% of all the velocities and those which exceeded 0.195 Nm/sec, i.e. 150% of the average linear velocity, accounted for 31% of all the velocities. The highest value was 284% of the average linear velocity and the lowest value was 20.1% of the average linear velocity.

The entire disclosure of Japanese Patent Application No. 2000-340759 filed on Nov. 8, 2000 including specification, claims, drawing and summary are incorporated herein by reference in its entirety.

What is claimed is:

1. A method for collecting a reversely subliming substance from a gas containing the substance, comprising:

preparing a shell-and-tube collecting apparatus capable of performing adhesion and collection of the substance on the inside surfaces of cooled collection tubes, the collection tubes being fixed with tube sheets to the apparatus so as to arrange in parallel with in the apparatus;

adjusting a pressure loss to be in the range of 0.05 to 50,000 Pa for the gas passing through the collection tubes; and introducing the gas into said apparatus.

2. A method according to claim 1, wherein the gas contains the substance in the range of 5 to 50 g/Nm$^3$.

3. A method according to claim 1, wherein said apparatus is vertically oriented.

4. A method according to claim 1, wherein the gas passes through the collection tubes, the collection tubes being cooled in a gas inlet portion thereof with a refrigerant at a temperature of 140° C. to 250° C. and in a remainder with a refrigerant at a temperature of 140° C. to 190° C.

5. A method according to claim 1, wherein said adjustment is performed by disposing baffle plates at the gas outlets of the collection tubes.

6. A method according to claim 5, wherein the baffle plate is a plate having a hole at a prescribed diameter formed in the central part thereof or a cone having top parts thereof truncated.

7. A method according to claim 1, wherein the collection tube has an inside diameter in the range of 100 to 500 mm.

8. A method for collecting a reversely subliming substance from a gas containing the substance, comprising:

preparing a shell-and-tube collecting apparatus capable of performing adhesion and collection of the substance on the inside surfaces of cooled collection tubes, the collection tubes being fixed with tube sheets to the apparatus so as to arrange in parallel with in the apparatus;

arranging an empty space under the lower part of cooled collection tubes;

introducing the gas into the empty space by adopting at least one of the following mechanisms:

(1) a gas-introducing tube the outlet direction of which has an angle larger than 90° relative to the directions in which the gas passes through the collection tubes, and (2) two or more gas-introducing tubes; and contacting the gas with the inside surfaces of the cooled collection tubes to perform adhesion and collection of the reversely subliming substance.

9. A method according to claim 8, wherein the gas contains the substance in the range of 5 to 50 g/Nm$^3$.

10. A method according to claim 8, wherein said apparatus is vertically oriented.

11. A method according to claim 8, wherein the angle is in the range of 90° to 270°.

12. A method according to claim 8 further comprising a projection of the collection tube from a lower tube sheet for fixing the lower parts of the collection tubes to the apparatus.

13. A method according to claim 12, wherein the projection has a length of 10 to 150 mm from the tube sheet.

14. A method according to claim 8, wherein a pressure loss is in the range of 0.05 to 50,000 Pa for the gas passing through the collection tubes.

15. A method according to claim 8, wherein a gas passing through the collection tubes has an average velocity of 0.05 to 1 Nm/sec.

16. A method according to claim 8, wherein the gas passes through the collection tubes, the collection tubes being cooled in a gas inlet portion thereof with a refrigerant at a temperature of 140° C. to 250° C. and in a remainder with a refrigerant at a temperature of 140° C. to 190° C.

17. A shell-and-tube collecting apparatus capable of adhering and collecting a reversely subliming substance from a gas containing the substance, comprising:

a plurality of collection tubes disposed in the apparatus by the tube sheets, each collection tube having an inside surface for collecting and adhering the reversely subliming substance from the gas flow and having an outside surface which is cooled by a refrigerant; and baffle plates disposed on the outlet parts of said collection tubes for controlling a pressure loss of the gas passing through said collection tubes.

18. An apparatus according to claim 17, wherein the collection tubes have a common, empty space formed in the lower part of the collecting apparatus for gas-introducing tubes and outlet directions of gas-introducing tubes having angles larger than 90° relative to the directions in which the gas passes through said collection tubes.

19. A method for collecting a reversely subliming substance from a gas containing the substance, comprising:

preparing a shell-and-tube collecting apparatus capable of performing adhesion and collection of the substance on the inside surfaces of cooled collection tubes, the collection tubes being fixed with tube sheets to the apparatus so as to arrange in parallel with in the apparatus;

arranging an empty space under the lower part of cooled collection tubes;

introducing the gas into the empty space by adopting a gas-introducing tube with a perforated plate at the outlet part thereof and at least one of the following mechanisms:

(1) a gas-introducing tube the outlet direction of which has an angle larger than 90° relative to the directions in which the gas passes through the collection tubes, and (2) two or more gas-introducing tubes; and contacting the gas with the inside surfaces of the cooled collection tubes to perform adhesion and collection of the reversely subliming substance.

* * * * *